US008746708B2

(12) United States Patent
Wang

(10) Patent No.: US 8,746,708 B2
(45) Date of Patent: Jun. 10, 2014

(54) CREEPER FOR CAR REPAIRING

(75) Inventor: Jingfang Wang, Jiangsu (CN)

(73) Assignee: Changshu Tongrun Auto Accessory Co., Ltd., Jiangsu (CN)

( * ) Notice: Subject to any disclaimer, the term of this patent is extended or adjusted under 35 U.S.C. 154(b) by 310 days.

(21) Appl. No.: 13/167,660

(22) Filed: Jun. 23, 2011

(65) Prior Publication Data

US 2012/0139198 A1 Jun. 7, 2012

(30) Foreign Application Priority Data

Dec. 7, 2010 (CN) ..... 2010 1 0576108

(51) Int. Cl.
*B25H 5/00* (2006.01)

(52) U.S. Cl.
USPC ..... 280/32.6

(58) Field of Classification Search
CPC ..... B25H 5/00; B62B 5/0083; B62B 3/00; B62B 3/02; B62B 3/10
USPC ..... 280/32.6, 32.5, 79.11
See application file for complete search history.

(56) References Cited

U.S. PATENT DOCUMENTS

| | | | | |
|---|---|---|---|---|
| 2,611,417 | A * | 9/1952 | Henry et al. | 280/30 |
| 2,680,027 | A * | 6/1954 | De Puydt et al. | 280/47.28 |
| 3,430,972 | A * | 3/1969 | Fiedler | 280/30 |
| 4,336,921 | A * | 6/1982 | Wienhold | 254/8 B |
| 4,934,718 | A * | 6/1990 | Voegele | 280/30 |
| 5,022,670 | A * | 6/1991 | Cote et al. | 280/32.6 |
| 5,941,543 | A * | 8/1999 | Kazmark, Jr. | 280/47.29 |
| 6,880,835 | B2 * | 4/2005 | Tornabene et al. | 280/30 |
| 7,090,210 | B2 * | 8/2006 | Lawrence et al. | 269/139 |
| 7,093,840 | B2 * | 8/2006 | Lucas et al. | 280/30 |
| 7,188,843 | B2 * | 3/2007 | Magness | 280/30 |
| 7,367,570 | B1 * | 5/2008 | Marsh | 280/32.6 |
| 7,481,438 | B2 * | 1/2009 | Hernandez | 280/32.6 |
| 8,573,607 | B2 * | 11/2013 | Meacham et al. | 280/32.6 |
| 2007/0013154 | A1 * | 1/2007 | Staples | 280/32.6 |

FOREIGN PATENT DOCUMENTS

| | | |
|---|---|---|
| CN | 2546284 Y | 4/2003 |
| CN | 2552778 Y | 5/2003 |
| CN | 2685025 Y | 3/2005 |
| CN | 2759717 Y | 2/2006 |
| CN | 2767077 Y | 3/2006 |

* cited by examiner

*Primary Examiner* — J. Allen Shriver, II
*Assistant Examiner* — James M Dolak
(74) *Attorney, Agent, or Firm* — Christie, Parker & Hale, LLP

(57) ABSTRACT

A creeper for car repair which belongs to the technical field of basic hand tools, includes a creeper body and an object scraper mechanism which is pivotally connected with one end of the creeper body. The technical solution provided by the present invention is equipped to an object scraper mechanism which is pivotally connected with one end of the creeper body for unfolding from the creeper body and being perpendicular to the service creeper body when the operator is standing upright and heavy objects are carried, as well as laying against the back of the service creeper body when the scraper mechanism is not being used and is folded, thus facilitating the object transportation and reducing the work intensity for the operators.

10 Claims, 3 Drawing Sheets

CREEPER FOR CAR REPAIRING

CROSS-REFERENCE TO RELATED APPLICATION

This application claims priority to and the benefit of Chinese Patent Application No. 201010576108.7, filed in the Chinese Intellectual Property Office, on Dec. 7, 2010, the entire content of which is incorporated herein by reference.

BACKGROUND

1. Field

The invention relates to the technical field of basic hand tools and particularly relates to a service creeper for car repair providing an operator of the service creeper with a transport mechanism that provides lie-down operational support and a scraper mechanism that assists, when upright, in conveniently moving objects, similar to that of a dolly or a forklift.

2. Description of Related Art

Disclosed Chinese Patent Documentation presents many forms of a creeper for use in car repair. For example, a utility model patent with patent publication number CN2552778Y provides a dismountable creeper for car repair, which can integrate all parts (e.g. the cushions and the framework which is equipped with rollers) without welding or riveting. In the process of transportation, the creeper is in a dismounting state to save both the packaging and space, therefore reducing the cost of warehouse and transportation. Another example, the creeper for car repairing recommended by CN2546284Y is provided with a folding function, which saves space to facilitate with minimal warehouse storage and easy transportation. Another example, a creeper disclosed by CN2685025Y, wherein, the creeper adjusts to the height of the bolster as needed through the setting of a bolster regulating mechanism, thus improving the comfort of the operator. Compared with the creeper for car repair of CN2685025Y, the creeper for car repair disclosed by CN2767077Y achieves the height adjustment through the setting of a headrest regulating mechanism without a regulating handle which may be an interference to the operators. For another example, a service creeper for car repair disclosed by CN2759717Y is provided with a convenient effect of dismounting front and rear bedsteads.

In addition to the creepers for use in car repair as listed above, other related art also has respective technical effects, however they all lack the multifunction of also providing upright assistance in moving heavy objects.

As those who routinely conduct operation of car repair would realize, the need to obtain accessories and/or relatively large and heavy tools is necessary in the process of repairing a vehicle. Therefore, a creeper for car repair that is equipped with a function for lie-down operational support and upright assistance in conveniently moving objects as needed, would improve the operation performance, reduce the labor intensity, and reduce manpower input of the operators. The technical solution introduced below is generated for this purpose.

SUMMARY

The object of the present invention is to provide a service creeper for use in car repair that is both conducive for lie-down operational support and for moving tools while upright as needed so as to reduce the labor intensity of the operators.

The present invention relates to a creeper for car repair comprising a service creeper body with an attached object scraper mechanism which is pivotally connected to one end of the creeper body for unfolding from the service creeper body and being perpendicular to the service creeper body when objects are carried as well as laying against the back of the service creeper body when the scraper mechanism is not being used and is folded.

In a specific embodiment of the present invention, the creeper body includes a pair of creeper frames that are arranged to each other in parallel, with each creeper frame having a hollow chamber; a lying mat with a headrest and a handle; and a group of fixing plates for the lying mat. The fixing plates for the lying mat are fixed at a certain distance between the pair of the creeper frames; the headrest is located at one end of the lying mat; and a group of fixing plates are fixed with the lying mat. One end of the handle is connected to one end of one creeper frame, the other end of the handle is connected to the corresponding end of the other creeper frame, and the middle part of the handle corresponds to the location of the headrest. A first roller is pivotally arranged at one end of the pair of creeper frames, wherein, the ends face toward the headrest. At the other end of the pair of creeper frames is a pin axle hole drilled into the creeper frame and a shovel board pivot is set respectively. The shovel board pivot is located externally under the pin axle hole of the creeper frame. The object scraper mechanism is connected with each pin axle hole of the pair of the creeper frames and is also pivotally connected with the pair of the shovel board pivots.

In another specific embodiment of the present invention, the object scraper mechanism includes a shovel board. A shovel board gudgeon is formed on each end along the longitude direction of the shovel board. A shovel board revolving axle hole is arranged on each shovel board gudgeon. The shovel board revolving axle hole is pivotally arranged on the shovel board pivot. A roller shaft is arranged between two shovel board gudgeons with a pair of axle heads protruding out of the shovel board gudgeons. The shovel board includes a pair of shovel board actuating devices having the same structure: one is connected with the creeper frame pin axle hole on one of the creeper frames and is also connected with one of the two axle heads of the roller shaft; while the other one is connected with the creeper frame pin axle hole on the other creeper frame and is also connected with the other axle head of the roller shaft. A pair of second rollers, one second roller in the pair of the second rollers is rotationally arranged on one of the pair of the axle heads, while the other second roller is arranged on the other axle head.

In another specific embodiment of the present invention, the pair of shovel board actuating devices includes a connecting rod, a connecting rod pin axle, a spring seat, and a spring. One end of the connecting rod is provided with a first connecting rod pin hole, and a second connecting rod pin hole is provided on the other end. The second connecting rod pin hole is cased on the axle head. The spring seat and the spring are arranged in the hollow chamber, wherein the lower end of the spring is supported either on the shovel board pivot or on the bottom wall of the creeper frame hollow chamber, and the upper end of the spring is supported on the spring seat. The connecting rod pin axle is successively inserted into the first connecting rod pin hole and the creeper frame pin axle hole; and the connecting rod gudgeon is coordinated with the spring seat.

In another specific embodiment of the present invention, a narrow groove is extended from and connected with the first connecting rod pin hole. A first recess and a second recess are formed on the connecting rod pin axle. The upper part of the spring seat is provided with a first locating flange and the lower part of the spring seat is provided with a second locating flange. The first locating flange is coordinated with either the first recess or the second recess. The upper end of the spring is supported on the second locating flange.

In another specific embodiment of the present invention, the tip of the connecting rod gudgeon is equipped with a snap spring groove on which a snap spring is arranged for restricting the movement of the connecting rod pin axle located on the creeper frame.

In a further specific embodiment of the present invention, the overall shape of the connecting rod is Z-shaped.

In a further specific embodiment of the present invention, the handle is connected with the pair of the creeper frames using a plug.

In a further specific embodiment of the present invention, the handle is permanently connected with the pair of the creeper frames.

The technical solution according to the present invention is a service creeper body with a transport mechanism that provides lie-down operational support and an object scraper mechanism which is connected to one end of the pivot of the service creeper body for unfolding from the service creeper body and being perpendicular to the service creeper body when the operator is standing upright and heavy objects are carried, as well as laying against the back of the service creeper body when the scraper mechanism is not being used and is folded, thus facilitating object transportation and reducing the work intensity for the operators.

DETAILED DESCRIPTION

The present disclosure will be described more fully hereinafter with reference to the accompanying drawings, in which exemplary embodiments of the present invention are shown. The present invention may, however, be embodied in many different forms and is not construed as limited to the exemplary embodiments set forth herein.

Figure 1:
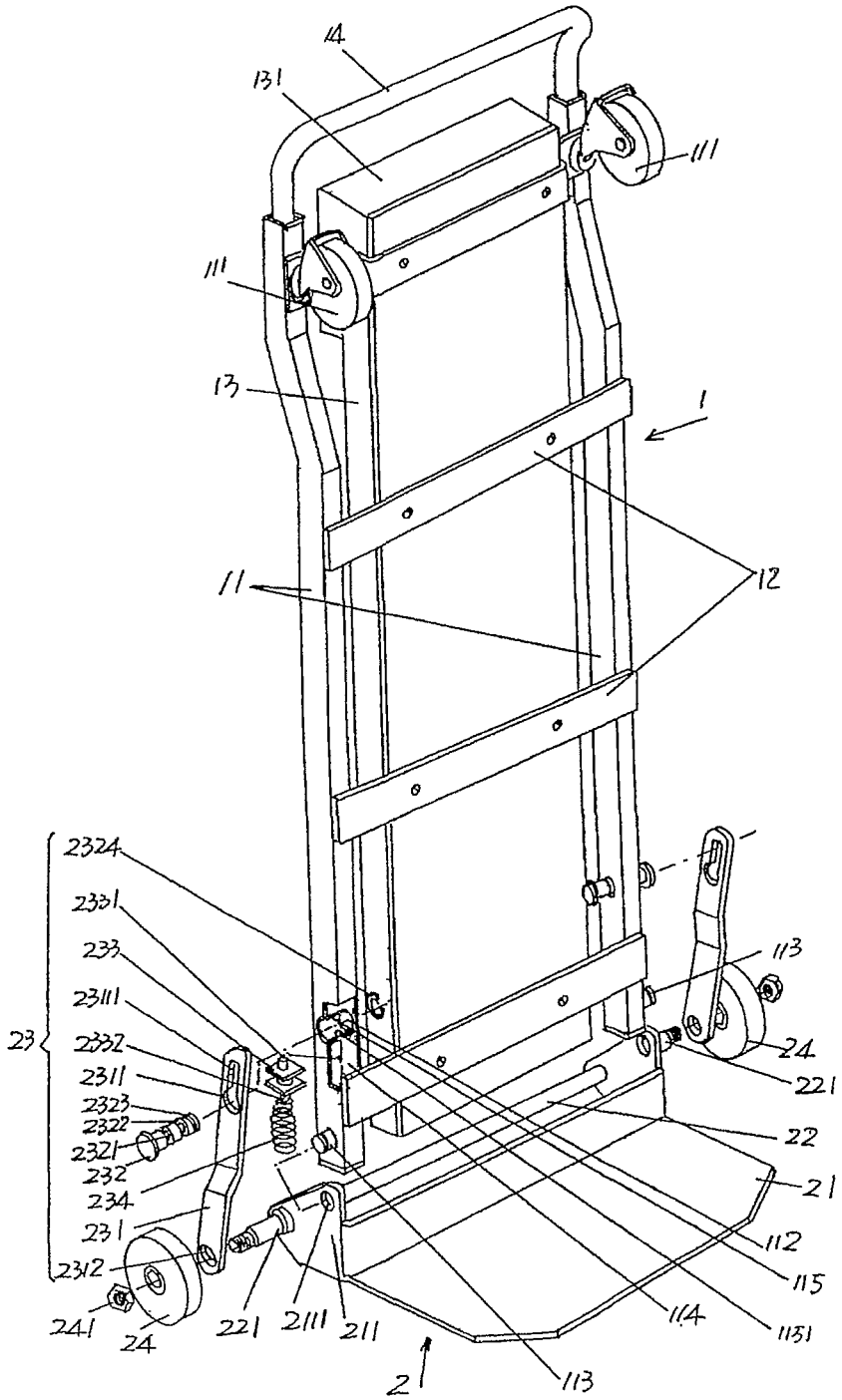
FIG. 1 is a structural drawing of a specific embodiment of the present invention.

Embodiment:

Referring to FIG. 1, the creeper body 1 includes a pair of creeper frames 11 (also referred to as the girder) that are arranged to each other in parallel and have the same shape. The pair of creeper frames 11 has a cavity in the center, i.e., hollow and the shape of the cross section is preferably square shaped, rectangular, or circular. As the creeper frame 11 is hollow, a hollow chamber 114 is formed. A group of fixing plates for the lying mat 12 (also referred to as the fixing strip for lying mat) is fixed at a certain distance between the pair of the creeper frames 11, namely, arranged along the longitudinal direction of the pair of the creeper frames 11. The fixing plate for the lying mat 12 and the creeper frame 11 can be fixed together by welding, riveting, or other similar ways such as screw retention. A lying mat 13 with headrest 131 and the fixing plate for the lying mat 12 are fixed together by screws. The headrest 131 is located at one end of the lying mat 13, which is preferably made of soft material, for example, a sponge covered with leather or similar fabric that is used to form the lying mat 13. One end of the handle 14 is conjugated (connected) to one creeper frame of the pair of the creeper frames 11, while the other end of handle 14 is conjugated (connected) to the other creeper frame of the pair of the creeper frames 11. The middle part of handle 14 corresponds to the location of the headrest 131, i.e., the lateral part protruding out of the headrest 131. The connection manner of the handle 14 with the pair of the creeper frames 11 can be permanent connection or pluggable connection (permanently connected or connected using a plug). This embodiment uses the latter.

Each end of the headrest 131 directed at the pair of the creeper frames 11 is pivotally equipped with a first roller 111; the other end of the pair of the creeper frames 11 is equipped with a creeper frame pin axle hole 112 and a shovel board pivot 113 which is located under the creeper frame pin axle hole 112 (for example, refer to the position shown in FIG. 1). Wherein, the creeper frame pin axle hole 112 is a through hole, which runs from one side of the creeper frame 11 to the other side of the creeper frame 11; one end of the shovel board pivot 113 is located in the hollow chamber 114 and the other end of the shovel board pivot 113 extends to the external side of the creeper frame 11 during operation.

In order to enable the creeper body 1 to multifunction both with lie-down operational support and while standing upright, provide operators with the ability to shovel and transport objects, the creeper frame pin axle hole 112 and the shovel board pivot 113 are equipped with the object scraper mechanism 2 (connected by pivots) for unfolding from the creeper body 1 and being perpendicular to the creeper body 1 when the objects are carried as well as laying against the back of the creeper body 1 when the scraper mechanism is not being used and is folded.

In FIG. 1, the transport mechanism 2 preferably includes the shovel board 21, roller shaft 22, a pair of shovel board actuating devices 23, and a pair of second rollers 24, however the current embodiment is not limited to the inclusion of these items. The shovel board gudgeon 211 is formed on each end of the side along the longitude direction of the shovel board 21, i.e., the side where the shovel board 21 is pivotally connected with the pair of the creeper frames 11. Each shovel board gudgeon 211 is equipped with a shovel board revolving axle hole 2111 which is pivotally connected with the shovel board pivot 113. According to the common knowledge, since there is a pair of shovel board gudgeons 211, the shovel board revolving axle hole 2111 on each shovel board gudgeon 211 shall be pivotally connected with the corresponding shovel board pivot 113 of the pair of shovel board pivots 113. The roller shaft 22 is arranged on the pair of shovel board gudgeons 211, i.e., the pivot is arranged between a pair of shovel board gudgeons 211 and the pair of axle heads of the roller shaft 22 that protrudes out of the shovel board gudgeons 211. A pair of second rollers 24 is rotationally arranged on the pair of axle heads 211, i.e., one second roller 24 in the pair of second rollers is arranged on one axle head 211 of the pair of axle heads 211, while the other second roller 24 is arranged on the other corresponding axle head 221. A pair of shovel board actuating devices 23 together have the same structure, and wherein one shovel board actuating device 23 is pivotally connected with the creeper frame pin axle hole 112 that is arranged on one of the pair of the creeper frames 11 and is also connected with one of the two axle heads 221 of the roller shaft; the other shovel board actuating device 23 is pivotally connected with the other creeper frame pin axle hole 112 of the other creeper frame 11 and is also connected with the other axle head 221 of the roller shaft.

Figure 2:
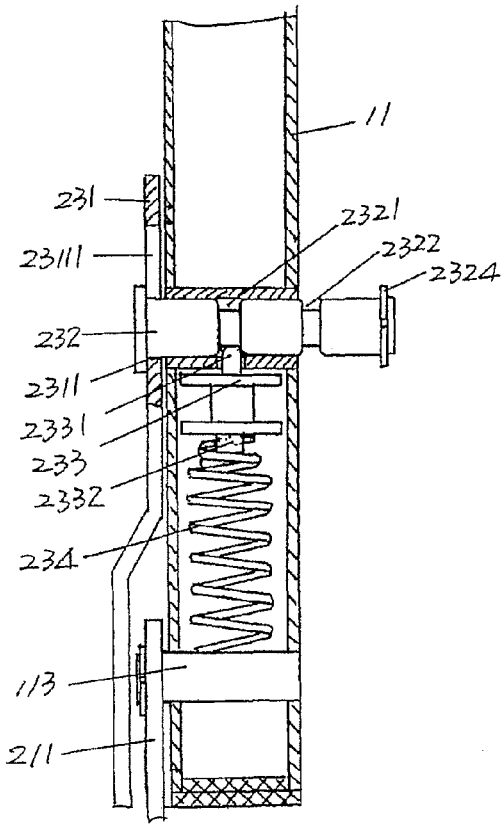
FIG. 2 is a structural drawing of the shovel board actuating device of the present invention.

In FIG. 1 and FIG. 2, as mentioned above, the pair of shovel board actuating devices 23 has the same structure and installation method; therefore, the shovel board actuating device 23 in FIG. 1 will be described in more detail below, while the shovel actuating device 23 in FIG. 2 will be omitted for convenience of description. Here, the description is directed to a shovel board actuating device 23 connected to the left creeper frame 11 in the pair of the creeper frames 11. The shovel board actuating device 23 preferably includes a connecting rod 231, a connecting rod pin axle 232, a spring seat 233, and a spring 234, however the current embodiment is not limited to the inclusion of these items. One end of the connecting rod 231, i.e., the upper end as shown in FIG. 1, is equipped with the first connecting rod pin hole 2311; and the lower end as shown in FIG. 1, is equipped with a second connecting rod pin hole 2312. The second connecting rod pin hole 2312 is cased on the axle head 221 on the left end of a pair of axle heads 221 of the roller 22. After the secondary connecting rod pin hole 2312 is cased on the axle head 221, a second roller 24 on the left of the pair of second rollers 24 is cased on the axle head 221 with the nut 241 screwed on the axle head 221 for fixing the connecting rod 231 and the second roller 24 together and preventing the connecting rod 231 and the second roller 24 from separating from the axle head 221. Both the spring seat 233 and the spring 234 are arranged in the hollow chamber 114, wherein the lower end of the spring 234 is supported on the shovel board pivot 113 in the hollow chamber 114 and can also be supported on the bottom wall of the hollow chamber 114. If the lower end of the spring 234 is supported on the shovel board pivot 113 in the hollow chamber 114, then the length of the spring 234 can become shorter and if the lower end of the spring 234 is supported on the bottom wall of the hollow chamber 114, then the spring 234 can become lengthy. The upper end of the spring 234 is supported on the spring seat 233, more specifically, the upper end of the spring seat 233 extends and is provided with the first locating flange 2331 and the lower end is provided with the second locating flange 2332. The upper end of the spring 234 is supported on the second locating flange 2332. If the lower end of the spring seat 233 is not equipped with the second locating flange 2332, but is equipped only with a spring fixing hole for the hooking of the upper end of the spring 234, the method is still practical. Therefore, the support manner of the spring 234 and spring seat 233 is not restricted by the embodiment. The connecting rod gudgeon 232 is successively inserted into the first connecting pin hole 2311 and the creeper frame pin axle hole 112. The first recess 2321, the second recess 2322, and the snap spring groove 2323 are formed (manufactured) on the connecting rod gudgeon 232. When the connecting rod gudgeon 232 is inserted into the creeper frame pin axle hole 112, the snap spring 2323 is placed on the snap spring groove 2324. The snap spring groove 2324 can be replaced by the cotter pin hole and the snap spring 2324 can be replaced by the cotter pin, accordingly. The first locating flange 2331 is matched with either the first recess 2321 or the second recess 2322.

In a preferable embodiment, an axle sleeve 115 is arranged in the hollow chamber 114 and on the position of the corresponding part of the frame pin axle hole 112. A locating flange hole 1151 is arranged on one side of the axle sleeve 115 and the side that faces the locating flange 2331. The connecting rod pin axle 232 is inserted into the axle sleeve 115 and the first locating flange 2331 is matched with the first recess 2321 or the second recess 2322 on the connecting rod pin axle 232 through the locating flange hole 1151. The first connecting pin hole 2311 extends and is equipped with a narrow groove 23111 so as to make the first connecting rod pin hole 2311 form a pear-shaped hole with one narrow end and one expanded end. Only when the first recess 2321 or the second recess 2322 is directed at the narrow groove 23111, can the connecting rod move.

If the first connecting rod pin hole 2321 and the narrow groove 23111 are arranged on the creeper frame 11, then the corresponding assembly method shall be appropriately changed. This change is regarded as a symbolic and non-material equivalent change and is still within the protection scope of the present invention.

APPLICATION EXAMPLE 1

Figure 3:
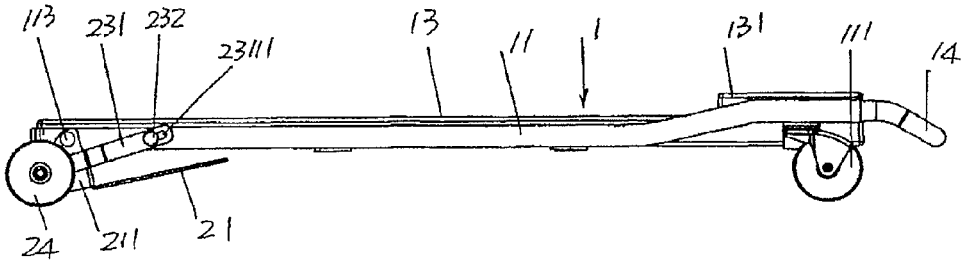
FIG. 3 is the schematic diagram showing the transport mechanism of FIG. 1 as folded and against the creeper body.

Referring to FIGS. 1, 2, and 3, the following description is only for the shovel board actuating device 23 in the left of FIG. 1 in the pair of shovel board actuating devices 23. When starting to use the object scraper mechanism 2 of the present invention to transport objects, such as accessories for car repairing and/or tools, the user manually pushes the right end of the connecting rod pin axle 232, i.e., pushes the end with the snap spring 2324 to enable the connecting rod pin axle 232 to move left and enable the first locating flange 2331, which was previously located in the first recess 2321 after overcoming the acting force of spring 234, to enter the second recess 2322. At this moment, the first recess 2321 appropriately corresponds to the narrow groove 23111. Under this state, the connecting rod 231 can move (shift), so as to enable the unfolding of the shovel board 21 to form a vertical relation (90°) with the creeper body 1 (as shown in FIG. 3). After the shovel board 21 is unfolded, the connecting rod pin axle 232 is to be moved to the right. The first recess 2321 previously located in the second recess 2322 enters the first recess 2321 and the connecting rod 231 is restricted in movement, so as to keep the locking position of the shovel board 21 in the active state. The operator holds the handle 14 and pushes the creeper body, and consequently, the needed objects are shoveled by the shovel board 21.

APPLICATION EXAMPLE 2

Figure 4:
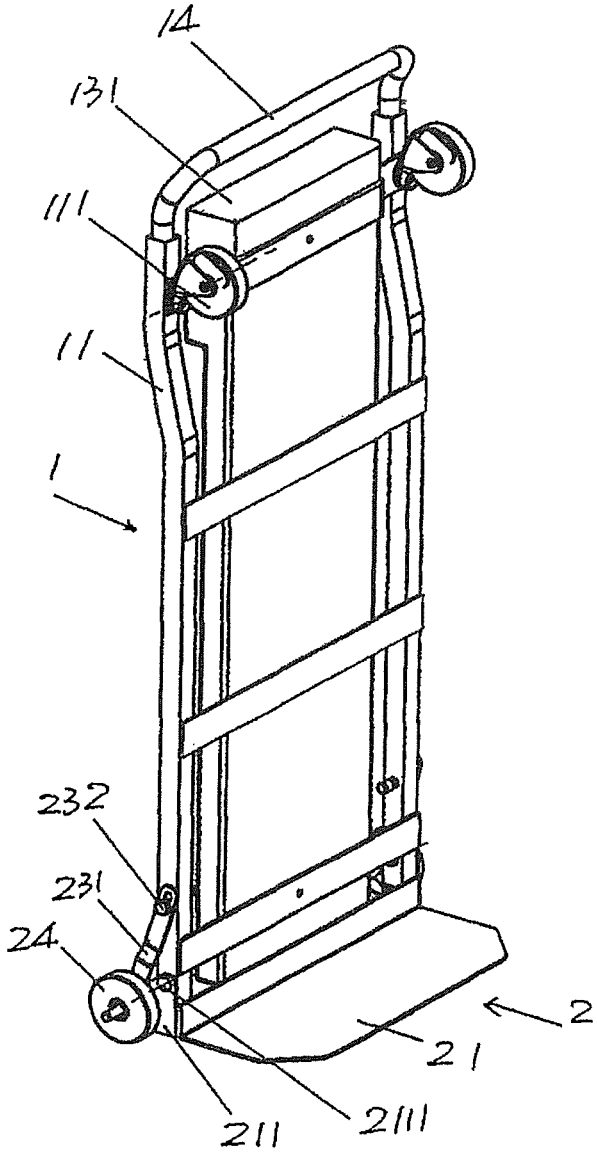
FIG. 4 is the schematic diagram showing the transport mechanism of FIG. 1 as unfolded and in state of transporting objects.

When the state shown in FIG. 3 is restored to the state shown in FIG. 4, i.e., the shovel board 21 lays against the back of the creeper body 1, the operation shall be carried out as the description in Application Example 1.

From the above description, the technical solution of the present invention provides the conventional function of the creeper along with the function of transporting objects, indicating a dual function of the creeper.

What is claimed is:

1. A creeper for car repair, the creeper comprising a creeper body (1) with an attached object scraper mechanism (2) which includes a shovel board (21); a shovel board gudgeon (211) arranged on each end along the longitudinal direction of the shovel board (21), respectively; a shovel board revolving axle hole (2111) pivotally arranged on each shovel board gudgeon (211), the shovel board revolving axle hole (2111) is pivotally arranged on the shovel board pivot (113); a roller shaft (22) arranged between the pair of shovel board gudgeons (211) with a pair of axle heads (221) protruding out of the shovel board gudgeons (221); a pair of shovel board actuating devices (23) having the same structure, and wherein, one shovel board actuating device (23) is connected with a frame pin axle hole (112) of one of a pair of creeper frames (11) and is also connected with one of the two axle heads (221) of the roller sharft (22), while the other shovel board actuating device (23) is connected with the frame pin axle hole (112) on the other creeper frame (11) and is also connected with the other axle head (221) of the two axle heads (221) of the roller shaft (22); a pair of second rollers (24), one second roller (24) in the pair of second rollers (24) is rotationally arranged on one axle head (221) of the pair of the axle heads (221), while the other second roller (24) is rotationally arranged on the other axle head (221) of the pair of the axle heads (221) the attached object scraper being pivotally connected to one end of the creeper body (1) for unfolding from the creeper body (1) and being configured to be perpendicular to the creeper body (1) when objects are carried as well as laying against the back of the creeper body (1) when the scraper mechanism is not being used and is folded.

2. The creeper for car repair according to claim 1, wherein the creeper body (1) for car repair includes the pair of creeper frames (11) that are arranged to each other in parallel, with each creeper frame having a hollow chamber (114); a lying mat (13) with a headrest (131) and a handle (14); and a group of fixing plates (12) for the lying mat (13), and wherein the fixing plates for the lying mat (12) are fixed at a distance between the pair of creeper frames (11); the headrest (131) is located at one end of the lying mat (13); the fixing plates (12) are fixed with the lying mat (13); one end of the handle (14) is connected with one end of one of the pair of creeper frames (11), and the other end of the handle (14) is connected with the corresponding end of the other creeper frame (11); the middle part of the handle (14) corresponds to the location of the headrest (131); a first roller (111) is pivotally arranged at each end of the headrest (131) facing to the pair of the creeper frames (11); the pin axle hole (112) of the frame (11) and a shovel pivot (113) are arranged at the other end of the pair of the creeper frames (11) respectively; the shovel board pivot (113) is located externally under the pin axle hole (112) of the creeper frame (11); the object scraper mechanism (2) is connected with each frame pin axle hole (112) of the pair of the creeper frames (11) and is also pivotally connected with the pair of shovel board pivots (113).

3. The creeper for car repair according to claim 1, wherein each of the pair of shovel board actuating device (23) includes a connecting rod (231), a connecting rod pin axle (232), a spring seat (233), and a spring (234); one end of the connecting rod (231) is provided with a first connecting rod pin hole (2311) and a second connecting rod pin hole (2312) is provided with on the other end; the second connecting rod pin hole (2312) is cased on the axle head (221); the spring seat (233) and the spring (234) are arranged in the hollow chamber (114), and wherein the lower end of the spring (234) is supported on either the shovel board pivot (113) or on the bottom wall of the hollow chamber (114) of the creeper frame (11), and the upper end of the spring (233) is supported on the spring seat (233); the connecting rod pin axle (232) is inserted into the first connecting rod pin hole (2311) and the frame pin axle hole (112); and the connecting rod pin axle (232) is coordinated with the spring seat (233).

4. The creeper for car repair according to claim 3, wherein a stricture groove (23111) is extended from and connected with the first connecting rod pin hole (2311), a first recess (2321) and a second recess (2322) are formed on the connecting rod pin axle (232), the upper part of the spring seat (233) is provided with a first locating flange (2331) and the lower part of the spring seat (2332) is provided with a second locating flange (2332); the first locating flange (2331) matches with either the first recess (2321) or the second recess (2322); and the upper end of the spring (234) is supported on the second locating flange (2332).

5. The creeper for car repair according to claim 3, wherein the tip of the connecting rod gudgeon (232) is equipped with a snap spring groove (2323), on which a snap spring (2324) is arranged for restricting the movement of the connecting rod pin axle (232) located on the creeper frame (11).

6. The creeper for car repair according to claim 3, wherein the overall shape of the connecting rod (231) is Z-shaped.

7. The creeper for car repair according to claim 2, wherein the handle (14) is connected with the pair of creeper frames (11) by a plug.

8. The creeper for car repair according to claim 2, wherein the handle (14) is permanently connected with the pair of creeper frames (11).

9. A creeper for car repair, the creeper comprising a creeper body (1) with an attached object scraper mechanism (2) which is pivotally connected to one end of the creeper body (1) for unfolding from the creeper body (1) and being configured to be perpendicular to the creeper body (1) when objects are carried as well as laying against the back of the creeper body (1) when the scraper mechanism is not being used and is folded, and wherein the creeper body (1) for car repair includes a pair of creeper frames (11) that are arranged to each other in parallel, with each creeper frame having a hollow chamber (114); a lying mat (13) with a headrest (131) and a handle (14); and a group of fixing plates (12) for the lying mat (13), and wherein the fixing plates for the lying mat (12) are fixed at a distance between the pair of creeper frames (11); the headrest (131) is located at one end of the lying mat (13); the fixing plates (12) are fixed with the lying mat (13); one end of the handle (14) is connected with one end of one of the pair of creeper frames (11), and the other end of the handle (14) is connected with the corresponding end of the other creeper frame (11); the middle part of the handle (14) corresponds to the location of the headrest (131); a first roller (111) is pivotally arranged at each end of the headrest (131) facing to the pair of the creeper frames (11); a pin axle hole (112) of the frame (11) and a shovel pivot (113) are arranged at the other end of the pair of the creeper frames (11) respectively; the shovel board pivot (113) is located externally under the pin axle hole (112) of the creeper frame (11); the object scraper mechanism (2) is connected with each frame pin axle hole (112) of the pair of the creeper frames (11) and is also pivotally connected with the pair of shovel board pivots (113).

10. A creeper for car repair, the creeper comprising a creeper body (1) with an attached object scraper mechanism (2) which includes a shovel board (21); a shovel board gudgeon (211) arranged on each end along the longitudinal direction of the shovel board (21), respectively; a shovel board revolving axle hole (2111) pivotally arranged on each shovel board gudgeon (211), the shovel board revolving axle hole (2111) is pivotally arranged on the shovel board pivot (113); a roller shaft (22) arranged between the pair of shovel board gudgeons (211) with a pair of axle heads (221) protruding out of the shovel board gudgeons (221); a pair of shovel board actuating devices (23) having the same structure, and wherein, one shovel board actuating device (23) is connected with a frame pin axle hole (112) of one of a pair of creeper frames (11) and is also connected with one of the two axle heads (221) of the roller shaft (22), while the other shovel board actuating device (23) is connected with the frame pin axle hole (112) on the other creeper frame (11) and is also connected with the other axle head (221) of the two axle heads (221) of the roller shaft (22); a pair of second rollers (24), one second roller (24) in the pair of second rollers (24) is rotationally arranged on one axle head (221) of the pair of the axle heads (221), while the other second roller (24) is rotationally arranged on the other axle head (221) of the pair of the axle heads (221), the attached object scraper mechanism (2) being pivotally connected to one end of the creeper body (1) for unfolding from the creeper body (1) and being configured to be perpendicular to the creeper body (1) when objects are carried as well as laying against the back of the creeper body (1) when the scraper mechanism is not being used and is folded, and wherein the creeper body (1) for car repair includes the pair of creeper frames (11) that are arranged to each other in parallel, with each creeper frame having a hollow chamber (114); a lying mat (13) with a headrest (131) and a handle (14); and a group of fixing plates (12) for the lying mat (13), and wherein the fixing plates for the lying mat (12) are fixed at a distance between the pair of creeper frames (11); the headrest (131) is located at one end of the lying mat (13); the fixing plates (12) are fixed with the lying mat (13); one end of the handle (14) is connected with one end of one of the pair of creeper frames (11), and the other end of the handle (14) is connected with the corresponding end of the other creeper frame (11); the middle part of the handle (14) corresponds to the location of the headrest (131); a first roller (111) is pivotally arranged at each end of the headrest (131) facing to the pair of the creeper frames (11); a pin axle hole (112) of the frame (11) and a shovel pivot (113) are arranged at the other end of the pair of the creeper frames (11) respectively; the shovel board pivot (113) is located externally under the pin axle hole (112) of the creeper frame (11); the object scraper mechanism (2) is connected with each frame pin axle hole (112) of the pair of the creeper frames (11) and is also pivotally connected with the pair of shovel board pivots (113).

* * * * *